US008931176B2

(12) United States Patent
Johnson et al.

(10) Patent No.: US 8,931,176 B2
(45) Date of Patent: Jan. 13, 2015

(54) BLADE CARTRIDGE GUARD COMPRISING AN ARRAY OF FLEXIBLE FINS EXTENDING IN MULTIPLE DIRECTIONS

(71) Applicant: The Gillette Company, Boston, MA (US)

(72) Inventors: Robert Harold Johnson, Melrose, MA (US); William Owen Jolley, Spencer, MA (US); Christian Reber Wester, San Diego, CA (US)

(73) Assignee: The Gillette Company, Boston, MA (US)

( * ) Notice: Subject to any disclaimer, the term of this patent is extended or adjusted under 35 U.S.C. 154(b) by 134 days.

(21) Appl. No.: 13/670,899

(22) Filed: Nov. 7, 2012

(65) Prior Publication Data

US 2014/0123496 A1 May 8, 2014

Related U.S. Application Data

(62) Division of application No. 12/796,819, filed on Jun. 9, 2010, now abandoned.

(51) Int. Cl.
*B26B 21/40* (2006.01)

(52) U.S. Cl.
CPC ..... *B26B 21/4018* (2013.01)
USPC ..... 30/34.2; 30/50; 30/77

(58) Field of Classification Search
CPC ..... B26B 21/00; B26B 21/02; B26B 21/04; B26B 21/06; B26B 21/4006; B26B 21/4012; B26B 21/4031; B26B 21/4037; B26B 21/42; B26B 21/40
USPC ..... 30/34.2, 47–51, 59, 63, 65, 70, 71, 73, 30/74.1, 76, 77, 79, 80; D28/47
See application file for complete search history.

(56) References Cited

U.S. PATENT DOCUMENTS

| | | | | |
|---|---|---|---|---|
| 2,559,189 | A | 7/1951 | Griffin | |
| 3,138,865 | A | 6/1964 | Meyer | |
| 3,722,090 | A | 3/1973 | Dawidowicz | |
| 4,069,580 | A * | 1/1978 | Cartwright et al. | 30/47 |
| 4,272,885 | A | 6/1981 | Ferraro | |
| 4,562,644 | A * | 1/1986 | Hitchens | 30/77 |
| 5,003,694 | A * | 4/1991 | Chen | 30/49 |
| 5,022,154 | A | 6/1991 | Johnson | |
| 5,067,238 | A | 11/1991 | Miller et al. | |
| 5,113,585 | A | 5/1992 | Rogers et al. | |

(Continued)

FOREIGN PATENT DOCUMENTS

| | | | |
|---|---|---|---|
| DE | 29520420 U1 * | 3/1996 | |
| DE | 102010022606 B4 * | 6/2012 | |

(Continued)

OTHER PUBLICATIONS

PCT International Search Report with Written Opinion in corresponding Int'l appln. PCT/US2010/038063 dated Aug. 31, 2010.

*Primary Examiner* — Jason Daniel Prone
(74) *Attorney, Agent, or Firm* — Kevin C. Johnson; Steven W. Miller

(57) ABSTRACT

Blade cartridges and razors employing such blade cartridges are provided. The cartridges contain a guard situated primarily on its leading edge that includes an array of flexible fins that extend in multiple directions.

2 Claims, 7 Drawing Sheets

(56) References Cited

U.S. PATENT DOCUMENTS

| | | | | |
|---|---|---|---|---|
| 5,295,305 | A | 3/1994 | Hahn et al. | |
| 5,313,705 | A * | 5/1994 | Rivers et al. | 30/50 |
| 5,386,750 | A * | 2/1995 | Morrison | 30/31 |
| 5,454,164 | A | 10/1995 | Yin et al. | |
| 5,546,660 | A * | 8/1996 | Burout et al. | 30/50 |
| 5,661,907 | A | 9/1997 | Apprille | |
| 5,678,311 | A | 10/1997 | Avidor | |
| 5,689,883 | A | 11/1997 | Ortiz et al. | |
| 5,781,997 | A | 7/1998 | Ferraro et al. | |
| 5,787,586 | A * | 8/1998 | Apprille et al. | 30/50 |
| 5,799,549 | A | 9/1998 | Decker et al. | |
| 5,933,960 | A * | 8/1999 | Avidor | 30/34.2 |
| 5,992,268 | A | 11/1999 | Decker et al. | |
| 6,651,342 | B1 | 11/2003 | Walker | |
| 6,675,479 | B1 | 1/2004 | Walker, Jr. et al. | |
| 6,684,513 | B1 | 2/2004 | Clipstone et al. | |
| 6,783,346 | B2 | 8/2004 | Bodmer et al. | |
| 6,866,894 | B2 | 3/2005 | Trankiem et al. | |
| D526,089 | S * | 8/2006 | Fischer et al. | D28/47 |
| 7,150,845 | B1 | 12/2006 | Gram | |
| 7,168,173 | B2 | 1/2007 | Worrick, III | |
| 7,197,825 | B2 * | 4/2007 | Walker et al. | 30/77 |
| 7,272,991 | B2 | 9/2007 | Aviza et al. | |
| 7,320,591 | B2 | 1/2008 | Gram | |
| 7,452,202 | B2 | 11/2008 | Gram | |
| 7,669,335 | B2 | 3/2010 | Walker et al. | |
| 7,730,619 | B2 * | 6/2010 | Ozenick | 30/49 |
| 8,024,863 | B2 * | 9/2011 | Wain | 30/50 |
| D665,130 | S * | 8/2012 | Wain et al. | D28/47 |
| 8,273,205 | B2 * | 9/2012 | Murgida | 30/34.2 |
| 8,407,900 | B2 * | 4/2013 | Johnson | 30/50 |
| 8,438,736 | B2 * | 5/2013 | Keene et al. | 30/50 |
| 8,448,338 | B2 * | 5/2013 | Sherman et al. | 30/50 |
| 8,533,961 | B2 * | 9/2013 | Nicoll et al. | 30/50 |
| 2004/0025350 | A1 * | 2/2004 | Richard et al. | 30/50 |
| 2004/0134072 | A1 | 7/2004 | Walker et al. | |
| 2005/0223568 | A1 * | 10/2005 | Walker et al. | 30/50 |
| 2005/0246899 | A1 * | 11/2005 | Wain | 30/49 |
| 2006/0080837 | A1 * | 4/2006 | Johnson et al. | 30/50 |
| 2006/0179661 | A1 | 8/2006 | Walker et al. | |
| 2007/0062044 | A1 * | 3/2007 | Walker et al. | 30/50 |
| 2007/0137045 | A1 * | 6/2007 | Follo et al. | 30/50 |
| 2008/0184563 | A1 * | 8/2008 | Hamadeh | 30/50 |
| 2009/0049695 | A1 | 2/2009 | Keene et al. | |
| 2009/0188112 | A1 * | 7/2009 | Prochaska et al. | 30/77 |
| 2009/0293281 | A1 * | 12/2009 | Bruno | 30/50 |
| 2010/0077618 | A1 * | 4/2010 | Peterson | 30/50 |
| 2010/0288294 | A1 * | 11/2010 | Fathallah et al. | 30/34.2 |
| 2010/0313424 | A1 * | 12/2010 | Johnson et al. | 30/34.2 |
| 2010/0319198 | A1 * | 12/2010 | Johnson et al. | 30/34.2 |
| 2011/0016724 | A1 | 1/2011 | Murgida | |
| 2012/0151772 | A1 * | 6/2012 | Moon et al. | 30/50 |
| 2012/0324737 | A1 * | 12/2012 | Howell et al. | 30/50 |
| 2013/0081276 | A1 * | 4/2013 | Wain et al. | 30/50 |
| 2013/0097872 | A1 * | 4/2013 | Blatter | 30/50 |
| 2013/0199346 | A1 * | 8/2013 | Psimadas et al. | 30/34.1 |
| 2014/0000114 | A1 * | 1/2014 | Wester et al. | 30/32 |
| 2014/0109409 | A1 * | 4/2014 | Fathallah et al. | 30/50 |
| 2014/0245612 | A1 * | 9/2014 | Good et al. | 30/41 |
| 2014/0245613 | A1 * | 9/2014 | Good et al. | 30/50 |

FOREIGN PATENT DOCUMENTS

| | | | |
|---|---|---|---|
| WO | WO 2007008360 | A1 * | 1/2007 |
| WO | WO 2007015220 | A1 * | 2/2007 |
| WO | WO 2010144638 | A1 * | 12/2010 |
| WO | WO 2013070335 | A1 * | 5/2013 |

* cited by examiner

BLADE CARTRIDGE GUARD COMPRISING AN ARRAY OF FLEXIBLE FINS EXTENDING IN MULTIPLE DIRECTIONS

This application is a divisional of application Ser. No. 12/796,819 filed on Jun. 9, 2010.

FIELD OF THE INVENTION

The present invention is directed to blade cartridges and razors employing such blade cartridges. The cartridges contain a guard situated primarily on its leading edge that includes an array of flexible fins that extend in multiple directions.

BACKGROUND OF THE INVENTION

Utilization of guards on the leading edge of razor blade cartridges is well known. Many guard designs contain a series of individual fins that are made from elastomeric materials, enabling them to flex back and forth as the blade cartridge is moved over the skin surface. The fins are designed to stimulate and stretch the skin in front of the blades to improve comfort and proper positioning of the skin for cutting of hairs growing outwardly from the skin The flexible fins on known commercial products tend to all point in the same vertical direction from a top portion of the respective blade cartridges. An example of this design approach is shown in the drawings of U.S. Pat. No. 6,675,479. As can be seen in FIG. 3 of the '479 Patent, fins 34 and 36 extend vertically from the top portion of cartridge 14. The vertical orientation is chosen so that the tips of the fins contact the skin at a relatively normal direction. It is believed that the normal direction contact via the fin tips may provide better skin stimulation/stretch as opposed to fin sidewall interaction that can occur if the fins are severely folded over on the skin Vertically oriented fins can work well when shaving hair-containing skin that is relatively firm and/or has relatively firm underlying tissue, such as on the upper cheeks. There are areas of skin, such as, for example, on the neck, that are more compliant and do not have significant underlying bone structure. When a razor cartridge is pressed against these more compliant skin areas, a skin bulge is created in front of the skin guard. As the razor is moved across the skin, a significant level of stress can occur on the front edge of the guard due to the front edge typically being a solid wall that does not contain flexible fins. And vertically-oriented fins that are positioned near the front edge of the guard tend to fold over in the presence of the high level of loading whereby their function of stretching and stimulating the skin may not be optimal. A need accordingly exists for a razor guard that employs flexible fins in both the vertical direction and other directions to reduce the loading on the front edge of the razor cartridge to improve glide, and to improve the interaction with the skin bulge formed in front of the guard when compliant skin is being shaved.

BRIEF DESCRIPTION OF THE DRAWINGS

While the specification concludes with claims particularly pointing out and distinctly claiming the subject matter which is regarded as forming the present invention, it is believed that illustrative embodiments of the present invention may be better understood from the following description taken in conjunction with the accompanying drawings, in which:

DETAILED DESCRIPTION OF THE INVENTION

The present invention may be understood more readily by reference to the following detailed description of illustrative and preferred embodiments. It is to be understood that the scope of the claims is not limited to the specific components, methods, conditions, devices, or parameters described herein, and that the terminology used herein is not intended to be limiting of the claimed invention. Also, as used in the specification, including the appended claims, the singular forms "a," "an," and "the" include the plural, and reference to a particular numerical value includes at least that particular value, unless the context clearly dictates otherwise. When a range of values is expressed, another embodiment includes from the one particular value and/or to the other particular value. Similarly, when values are expressed as approximations, by use of the antecedent basis "about," it will be understood that the particular values form another embodiment. All ranges are inclusive and combinable.

Figure 1:
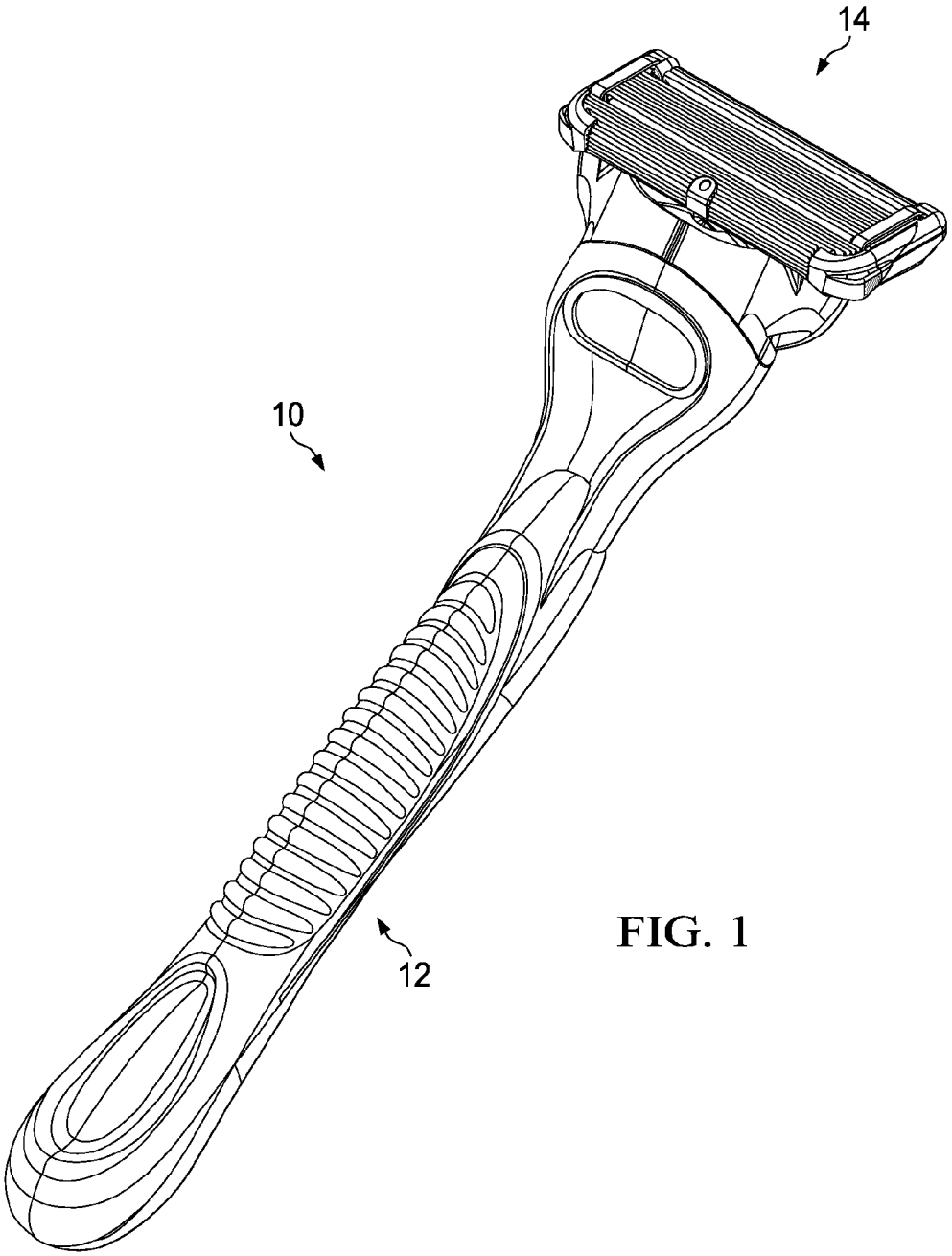
FIG. 1 is a perspective view of a first razor embodiment of the present invention.

Referring now to the figures and in particular to FIG. 1, an exemplary razor 10 is shown, which includes a handle 12 and a blade cartridge 14. The razors of the present invention may be designed to employ and receive replaceable blade cartridges. The razors included herein may also have blade cartridges that are designed to be permanently affixed to the handle, wherein the entire razor is discarded when its perceived effective use is deemed to have been depleted. Handle 12 can be made from a thermoplastic material and by any methods known to the skilled artisan for forming thermoplastic materials. By way of example only, the handle or parts thereof can be injection molded from a polyolefin (including a polyethylene polypropylene). The handle can comprise a single thermoplastic material or multiple thermoplastic materials (including thermoplastic elastomers) via multi-shot molding techniques, including the use of rotating mold technology, such as those described in U.S. Pat. Nos. 6,783,346; 7,150,845; 7,320,591; and 7,452,202, and PCT published application no. WO 2007/096309.

Figure 2:
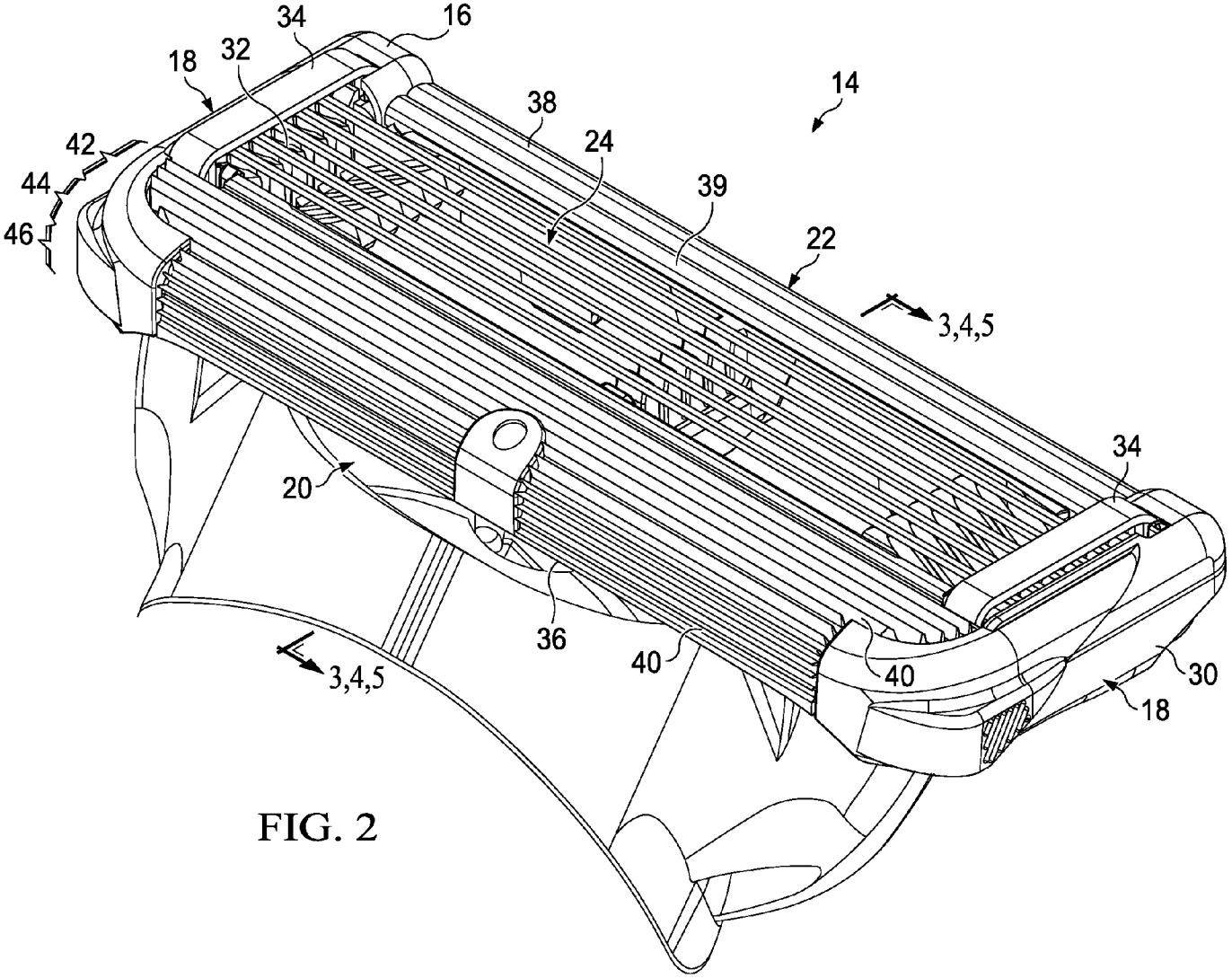
FIG. 2 is an enlarged perspective view of the blade cartridge associated with the first razor embodiment.

An enlarged view of blade cartridge 14 is shown in FIG. 2. Blade cartridge 14 has a top portion 16, opposing side portions 18, a leading edge or front portion 20 (in relation to the shaving motion), and a trailing edge or rear portion 22. Top portion 16 contains a window 24 for accessing one or more cutting blades. Although exemplary blade cartridge 14 is shown with five blades, the number can vary, with more than five blades and with as few as a single blade being possible.

Exemplary cartridge 14 employs a number of different components. Cartridge 14 includes a housing 30, five cutting blades 32, clips 34 for retaining the blades in the housing, a guard 36, and a cap 38 that includes a lubricating strip 39. Housing 30 can be made from a thermoplastic material, such as, for example, polyethylene terephthalate, polyethylene, and polypropylene. Known plastic forming techniques (e.g., injection molding) may be used to manufacture the housing. Blades 32 are preferably made from a metal, such as, for example, steel. The cutting edges of blades 32 may optionally contain a coating material, such as those described in U.S. Pat. Nos. 5,295,305; 5,799,549; 5,992,268; 6,684,513; and 6,866,894. Clips 34 may be made from a variety of materials, including, for example, 5052-H16 Aluminum. Lubricating strip 39 can be made from a material comprising a mixture of a hydrophobic material and a water leachable, hydrophilic polymer, as is known in the art, and as described by way of example in U.S. Pat. Nos. 5,113,585 and 5,454,164.

Exemplary guard 36 will be further described with reference to FIG. 2. Guard 36 comprises an array of flexible fins 40, which includes a plurality of fins 42 that substantially extend from the cartridge top portion 16, a plurality of fins 46 that substantially extend from the cartridge front portion 20, and one or more fins 44 that extend outwardly from the transition region or intersection of top portion 16 and front portion 20.

Guard 36 can be made from elastomer or non-elastomer thermoplastic materials, or a mixture of the two. The guard can be manufactured separately from the cartridge housing, or can be co-molded with the same. The fins of the present invention are designed to have some degree of flexibility, and with this in mind, can be made from an elastomeric material or a blended material incorporating an elastomeric material. The fins may also be made from relatively "soft" thermoplastic materials that are generally not considered elastomers, such as, for example, low molecular weight polyethylene. A representative, and non-limiting, list of suitable materials for the fins includes synthetic elastomers based on SEBS, SEPS, TPV, or thermoplastic polyurethane type. The fin material can have a hardness property of from about 28 to about 60 Shore A hardness. Exemplary fins have a tip to base height of from about 0.15 mm to about 0.9 mm and a narrow profile (that is, define an included angle of less than about 25 degrees), a width dimension of from about 0.1 mm to about 0.4 mm at their bases, and are spaced center-to-center from about 0.1 mm to about 0.6 mm It should be appreciated that fins having different dimensions and a different geometrical relationship than this may also be employed. Where the fins have a different base reference on either side of the tip (that is, have different sidewall lengths), then the height can be calculated as the average of the two measurements from base to tip.

Referring again to FIG. 2, fins 44 and 46 are employed to interact with a skin bulge that can form against and/or around the leading edge of a blade cartridge. As discussed in the background section, skin bulges can arise in areas of the face and neck where more compliant skin resides or where there is little to no hard tissue underlying the skin. The positioning of these fins can help remove excess shaving preparation prior to passing the blades over the skin to be shaved. The positioning of these fins can also increase the probability that one or more fins contact the skin bulge and follow the skin bulge profile, via their respective tips, at a normal direction. Fins that maintain a relatively normal direction to the surface of the skin rather than folding over are believed to better perform a function of stretching and stimulating the skin to improve shaving closeness and comfort.

Figure 3:
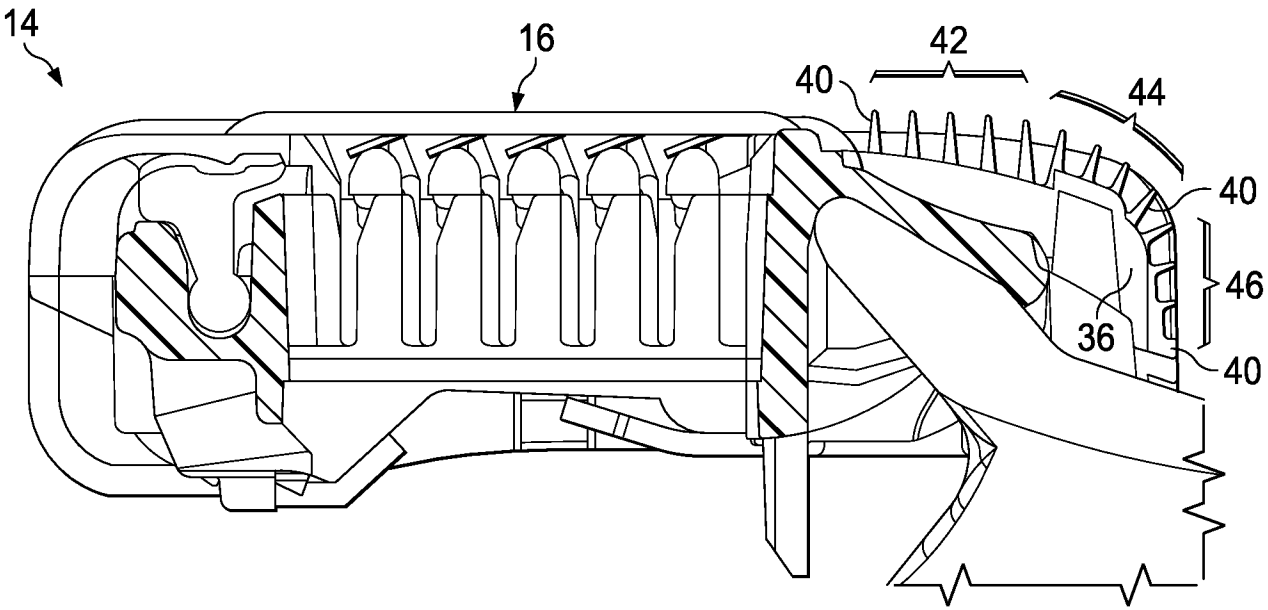
FIGS. 3-5 are sectional views of the blade cartridge embodiment shown in FIG. 2.
Figure 4:
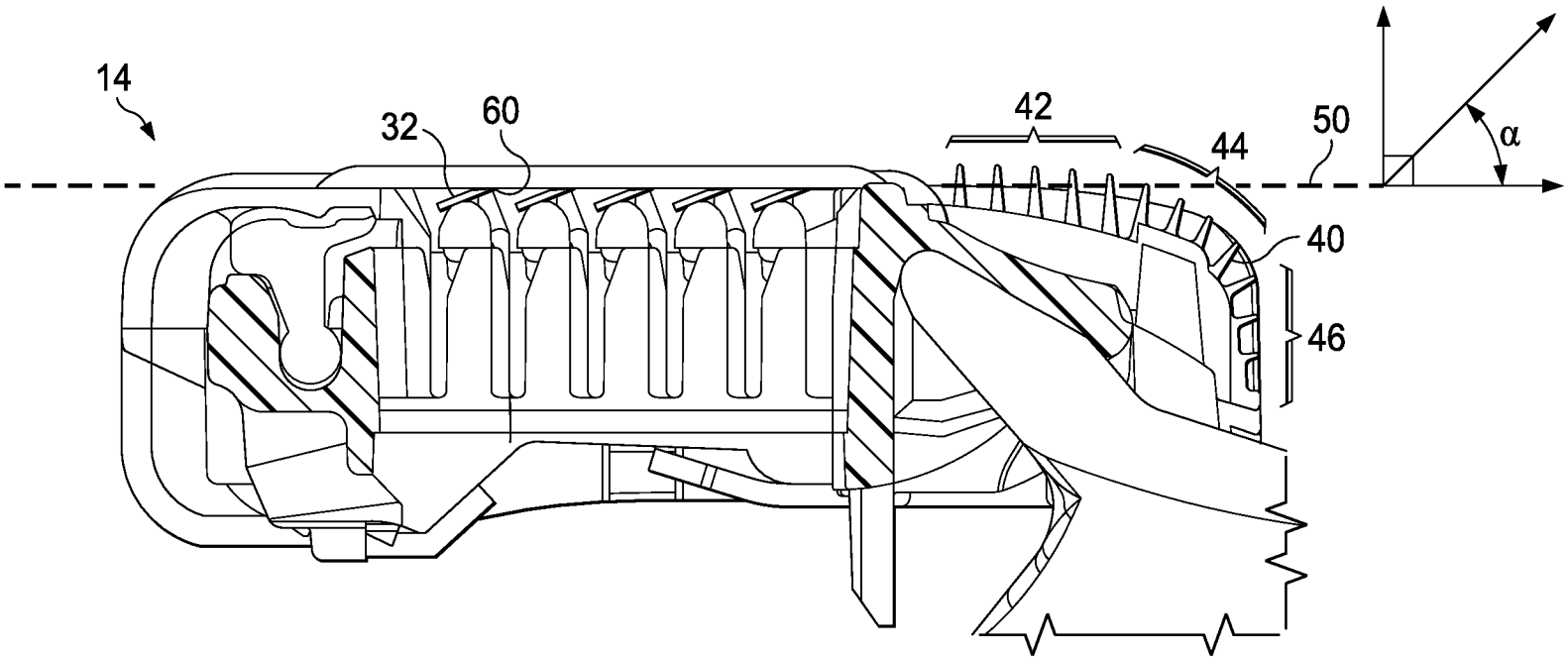
Figure 5:
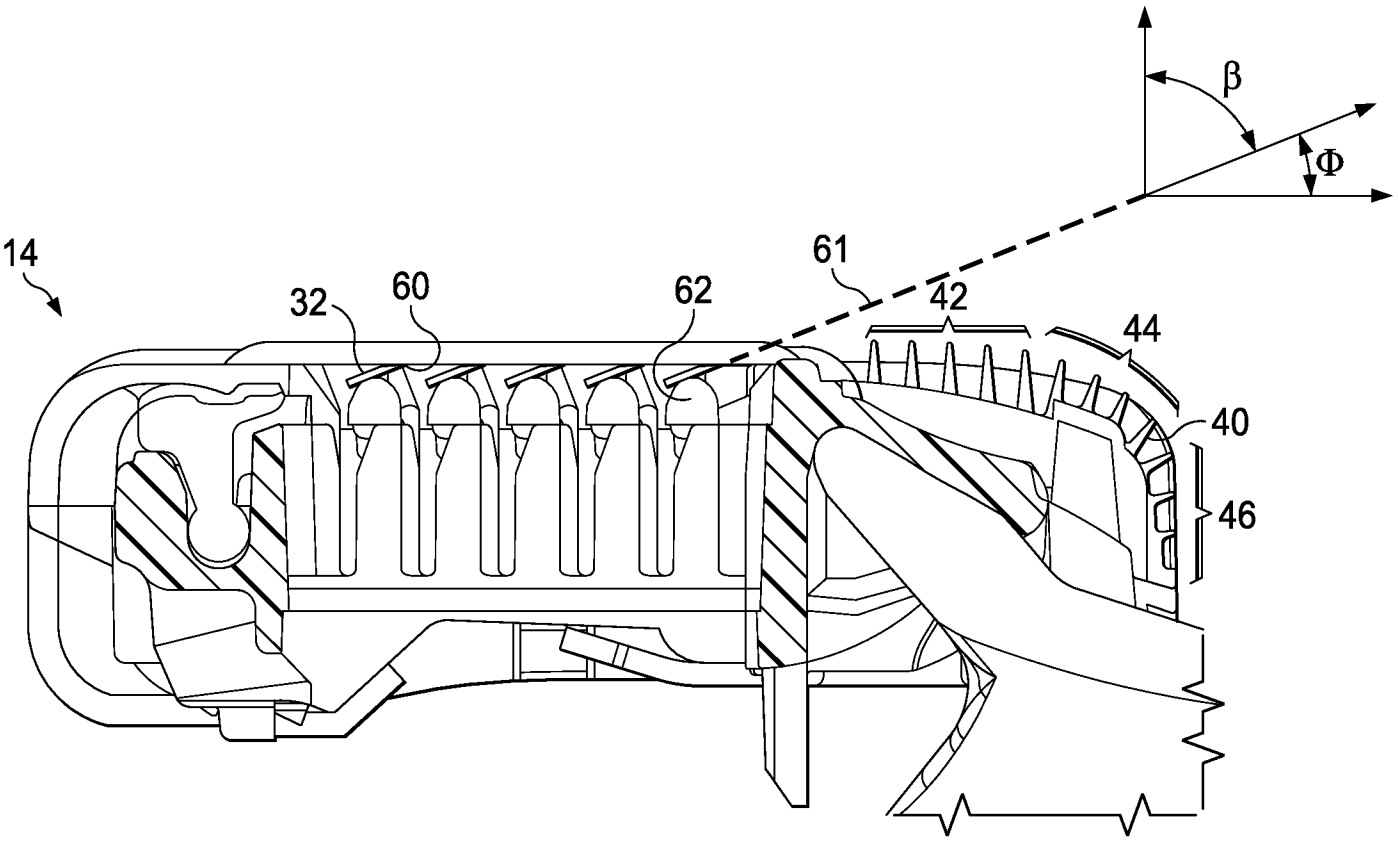

Additional design feature and considerations for the guard fins are discussed in conjunction with FIGS. 3-5, which illustrate sectional views of exemplary cartridge 14. Referring now to FIG. 3, guard 36 is illustrated with the array of fins 40 that includes a plurality of fins 42, 44, and 46 that are positioned to extend in multiple directions. As can be seen in FIG. 3, the plurality of fins 42 extend substantially in a first vertical direction, the plurality of fins 46 extend in a second direction that is substantially orthogonal to the first direction, and the plurality of fins 44 extend outwardly in an arcuate manner at the transition point of the cartridge front edge. Fins 42 are positioned to contact skin that is positioned substantially parallel with the top portion 16 of the blade cartridge, while fins 44 and 46 are positioned to contact a skin bulge that arises in front of the blade cartridge during the shaving process.

With reference now to FIG. 4, fins 40 on cartridge 14 are described in relation to the cutting edges 60 of blades 32 since the fins and blades can work in concert with one another to provide a close and comfortable shave. Accordingly, a plane 50 that passes through the cutting edges 60 is included for defining the positioning of the various fins 42, 44, and 46. Fins 42 extend in a direction that is substantially at a 90 degree angle from plane 50, fins 44 transition from fins 42 and extend in varying directions to a direction that is approaching a 45 degree angle $\alpha$ from plane 50, and fins 46 transition from fins 44 and extend in varying directions to a direction that is approaching parallel to plane 50. Similarly and with reference to FIG. 5, fins 40 on cartridge 14 are described in relation to the directional aspect of the portion of the blade shank 62 that is adjacent or proximate the cutting edges 60 of each of the blades 32. Fins 42, 44 and 46 extend in varying directions that are substantially 25, 30, 35, 40, 45, or 60 degrees (angles $\beta$ and $\Phi$, respectively) relative to plane 61.

Figure 6:
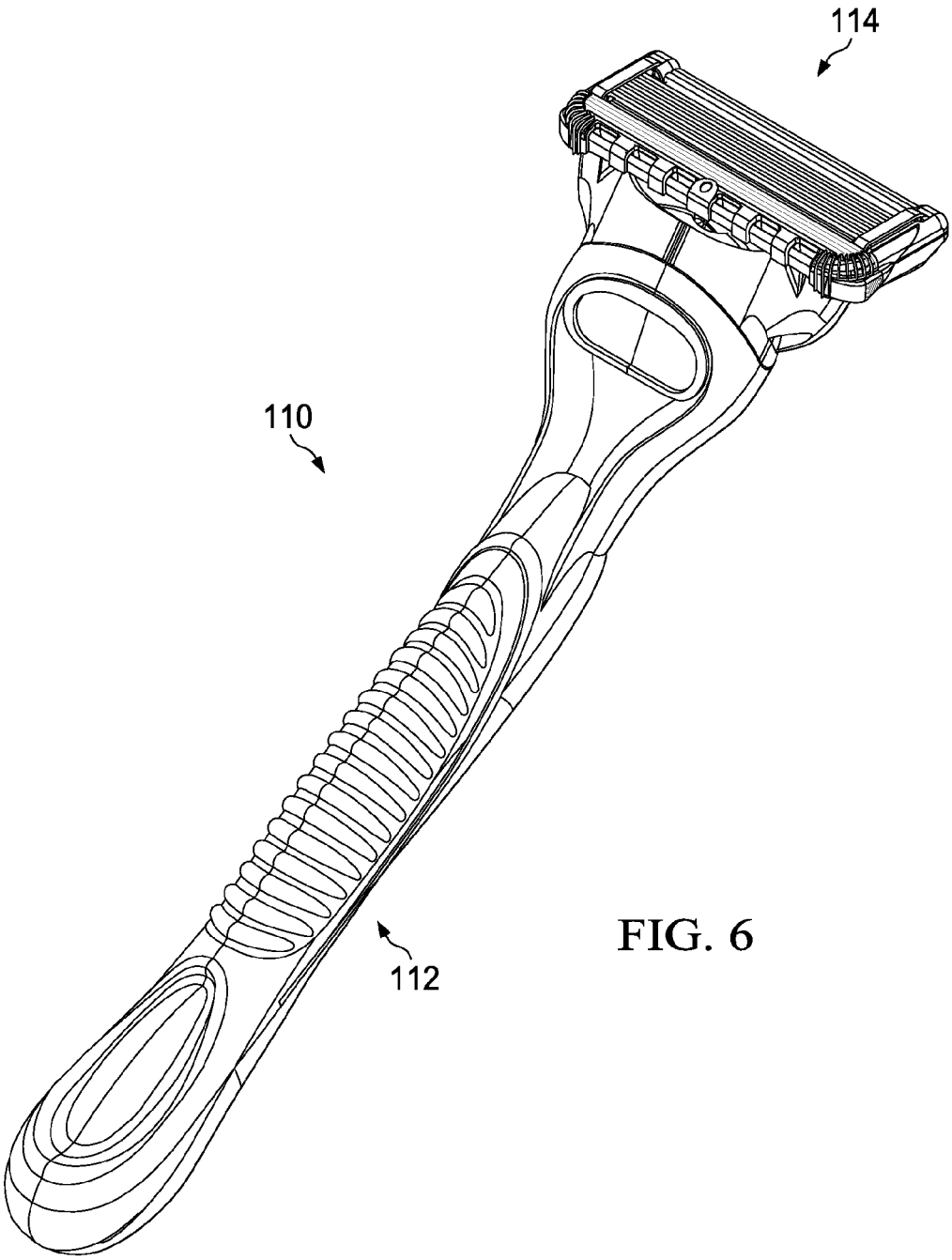
FIG. 6 is a perspective view of a second razor embodiment of the present invention.

A second razor embodiment 110 is shown in FIG. 6. Razor 110 includes a handle 112 and an exemplary blade cartridge 114. An enlarged perspective view of exemplary cartridge 114 is provided in FIG. 7. Blade cartridge 114 has a top portion 116, opposing side portions 118, a leading edge or front portion 120, and a trailing edge or rear portion 122. Top portion 116 contains a window 124 for accessing one or more cutting blades 132. Exemplary cartridge 114 employs similar components to that of cartridge 14 discussed above. Cartridge 114 includes a housing 130, cutting blades 132 supported by the housing, clips 134 for retaining the blades in the housing, a guard 136, and a cap 138 that includes a lubricating strip 139.

Guard 136 is shown having three separate arrays of flexible fins. A first array of fins 142 is positioned on the cartridge top portion 116 and proximate the blades 132. The second and third array of fins 144 and 146 are situated at the cartridge front corners; that is, at the intersection or transition point of cartridge top portion 116, front portion 120, and side portions 118. One of skill in the art would readily appreciate that while the fins associated with arrays 142, 144, and 146 are shown as being distinct from one another, a single array of fins could exist wherein fins 144 and 146 are manufactured with and/or attached to fins 142. It should be noted that in an alternative embodiment, the first array of fins 142 is omitted and only the corner array of fins 144 and 146 exist.

Figure 7:
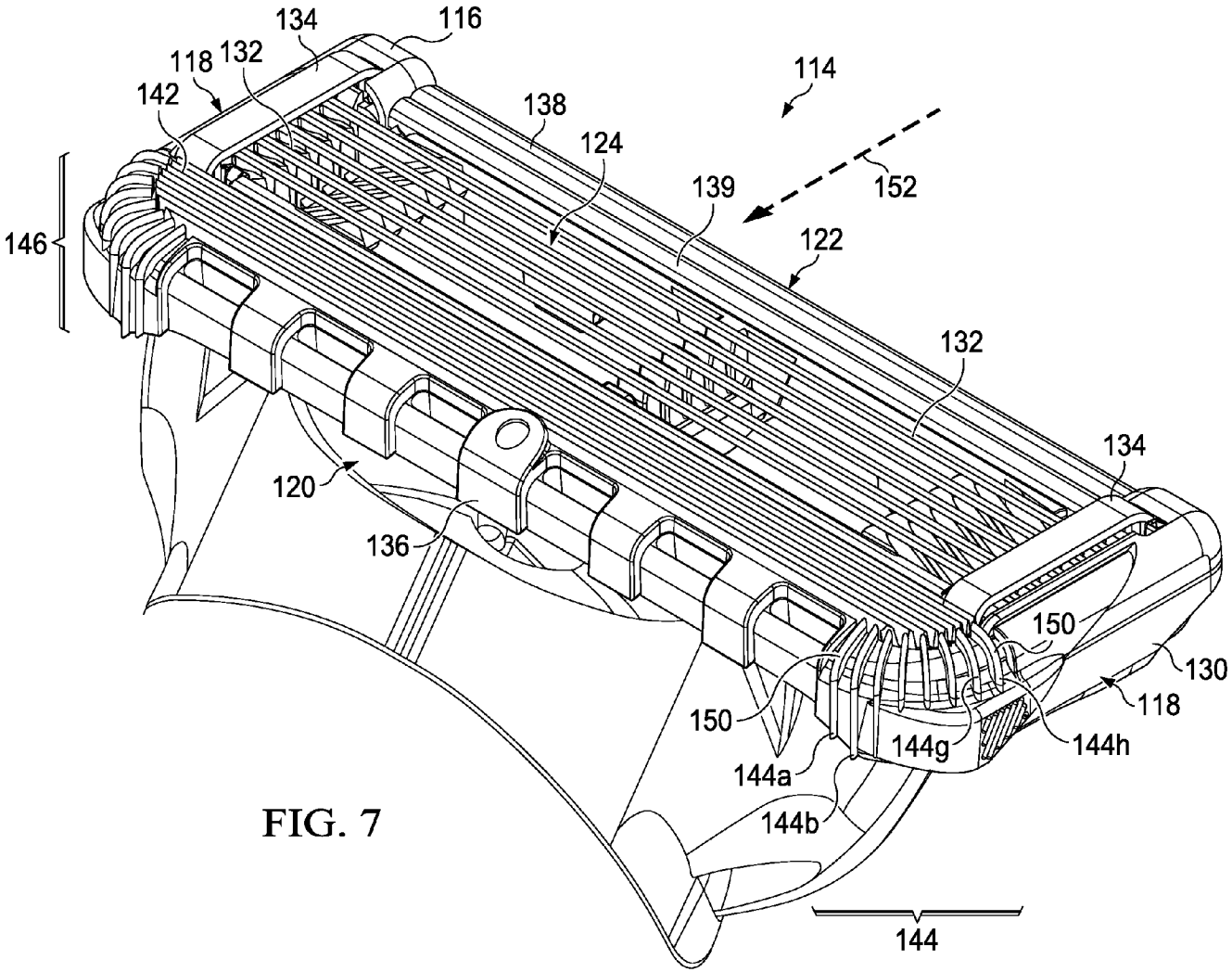
FIG. 7 is an enlarged perspective view of the blade cartridge associated with the second razor embodiment.

As can be seen in FIG. 7, the individual fins encompassed within arrays 144 and 146 extend in multiple directions via the placement all the way around the cartridge front corners. As a result of this, some of the fins (e.g., 144*a* and 144*b*) have sidewalls 150 that are oriented/extend in a direction that is generally aligned with the cutting direction 152. These fins can improve the lateral stability of the blade cartridge. Some of the fins (e.g., 144*g* and 144*h*) have sidewalls 150 that are oriented/extend in a direction that is generally perpendicular to the cutting direction 152. These fins may help increase skin stretching at the outside of the skin stretch profile.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A shaving blade unit, comprising:

(a) a top portion comprising a window for accessing one or more blades supported by the shaving blade unit, a front portion extending downward and away from the top portion; opposing side portions extending downward and away from the top portion and rearward from the front portion, and an intersection portion engaging each of the top portion, the front portion and one of the side portions; and (b) a plurality of fins extending outwardly from the intersection portion.

2. A shaving blade unit, comprising:

(a) a housing having a top portion, a front portion extending downward and away from the top portion, opposing side portions extending downward and away from the top portion and rearward from the front portion, and an intersection portion engaging each of the top portion, the front portion and one of the side portions;

(b) one or more blades supported by the housing, each of the one or more blades comprising a cutting edge oriented so as to define a cutting direction; and (c) a guard member disposed on the housing, the guard member comprising a plurality of fins extending outwardly from the intersection portion.

* * * * *